US006203171B1

(12) United States Patent
Sherman, Jr.

(10) Patent No.: US 6,203,171 B1
(45) Date of Patent: Mar. 20, 2001

(54) APPARATUS FOR CREATING AN ORNAMENTAL LIGHTING DISPLAY

(76) Inventor: Robert T. Sherman, Jr., 1207 Robin Trail, Roundrock, TX (US) 78681

( * ) Notice: Subject to any disclaimer, the term of this patent is extended or adjusted under 35 U.S.C. 154(b) by 0 days.

(21) Appl. No.: 08/850,943

(22) Filed: May 5, 1997

(51) Int. Cl.[7] ..... F21V 21/00

(52) U.S. Cl. ..... 362/249; 362/121; 362/124; 362/249; 362/252; 362/807; 362/227; 362/806; 362/808

(58) Field of Search ..... 362/121, 124, 362/249, 252, 807, 227, 806, 808

(56) References Cited

U.S. PATENT DOCUMENTS

| | | | | |
|---|---|---|---|---|
| 3,009,052 | | 11/1961 | Holbrook . | |
| 3,041,446 | | 6/1962 | Erlewine et al. . | |
| 3,244,870 | | 4/1966 | Gallant et al. . | |
| 3,551,723 | * | 12/1970 | Groningen | 313/250 |
| 3,681,589 | | 8/1972 | Roberts | 240/10.1 |
| 3,704,366 | | 11/1972 | Korb et al. | 240/10 T |
| 3,731,081 | | 5/1973 | Yellin | 240/10 R |
| 4,453,201 | * | 6/1984 | Prouty | 362/121 |
| 4,462,065 | * | 7/1984 | Rhodes | 362/250 |
| 4,901,212 | * | 2/1990 | Prickett | 362/145 |
| 5,077,646 | | 12/1991 | Parsons | 362/252 |
| 5,255,170 | * | 10/1993 | Plamp et al. | 362/183 |
| 5,567,045 | | 10/1996 | Bucek | 362/363 |
| 5,601,361 | | 2/1997 | Lawrence | 362/238 |
| 5,645,343 | * | 7/1997 | Rinehimer | 362/252 |
| 5,769,533 | * | 6/1998 | Yamuro | 362/249 |
| 5,823,659 | * | 10/1998 | Klose | 362/252 |

* cited by examiner

*Primary Examiner*—Stephen Husar
*Assistant Examiner*—John Anthony Ward
(74) *Attorney, Agent, or Firm*—Fulbright & Jaworski, LLP

(57) ABSTRACT

The present invention provides an apparatus for attachment to a permanent object to enable a unitary lighting display between apparatus and permanent object. The present invention includes a shaft member adapted to extend along at least a portion of the object, and a structural member attached to the shaft member. The structural member is configured to extend at least partially around the permanent object so as to enable the apparatus to be fitted around the permanent object. The apparatus is adapted to mount a lighting display integral in appearance with a lighting display on the permanent object to thereby enable the unitary lighting display.

18 Claims, 4 Drawing Sheets

APPARATUS FOR CREATING AN ORNAMENTAL LIGHTING DISPLAY

BACKGROUND OF THE INVENTION

The present invention relates generally to an apparatus used in connection with an ornamental lighting display.

Various ornamental lighting displays are known and used to decorate interior and exterior spaces. Ornamental displays are particularly used during holiday seasons, such as Christmas or Easter.

One type of ornamental lighting consists of a plurality of bulbs connected in series with an insulating wire between successive lights. Such a strand of lights may be draped around a Christmas tree or hung along a window frame or along a roof or side of a house, building or other such structure. Additionally, the strand may be wrapped around the trunk of a tree or a pole to provide ornamental lighting of the tree or pole. Further, the strand may be draped throughout branches of a tree to provide for lighting of the tree.

It is known in the art to provide a group of elongate tubular members to simulate tree branches bearing lights. These tubular members are attached to a tree to simulate the appearance of lighted tree branches. It is also known to string such ornamental lights in a movable and flexible net that may be draped over an object having any type of contour. Other known apparatus include an ornamental lighting frame in the shape of a star that has a number of small openings, each having a retainer, so that light bulbs may be supported by the frame.

It is also known that a preformed design, such as a candy cane, may be fabricated with a plurality of openings in which to insert light bulbs, and having interior wires connected thereto, thus providing for a lighted display while hiding the interior wires. Further, it is also known that wire or similar material may be shaped into a frame having the appearance of various objects including, for example, a reindeer, Santa Claus, or a Christmas tree. These frames may then have strings of lights attached to them to provide for an ornamental display in the desired shape.

There are certain problems with these known apparatus for lighting displays. For example, it is not possible to create a unitary display between an ornamental lighting frame and a permanent object, such as a tree or light post, as the frame generally cannot be attached to the object effectively. Even if such known frames are attached to a stationary object, the lighting provided by the display does not provide for continuous lighting between the object and the frame. Further, such a frame does not utilize the stationary object's properties (i.e., size, mass, and shape) effectively. Rather, such a frame uses the stationary object only to remain stationary or suspended. These frames do not envelop or engulf any portion of the stationary object into its design, the design thereby remaining separate from the object. Great amounts of raw materials are required to build a unitary display of the prior art, as only a frame alone can create a unitary display. It is therefore desired to create a uniform lighting display between an object and an ornamental lighting frame so that when activated it appears that the object and lighting frame are a unitary object.

SUMMARY OF THE INVENTION

The invention, in a broad aspect, comprises a lighting structure which may be temporarily added to a permanent structure such that the two structures appear to blend or integrate with one another to form a single structure. Moreover, lighting displays associated with the two structures appear to become a unitary or single display. The apparatus of the invention more particularly is configured to surround or otherwise encompass the permanent structure but is readily removable from the latter structure for ready storage and reuse. In certain embodiments, two or more lighting structures may be attached to the permanent structure.

The invention, in one preferred aspect, comprises a frame which is sufficiently open along at least a portion of its length to fit around or encase a permanent structure and which may be deformed or provided with interengaging members to hold the frame and the permanent structure together. Lighting displays on the frame and the permanent structure are configured to enable the two to merge without interference. The result is the appearance of a single structure with a single unitary and continuous display. The frame includes contour trace lines, which are used incorporate the stationary object into the display, thereby providing for continuous lighting along a transition area between stationary object and frame.

In another preferred aspect, the temporary frame or structure may extend beyond or branch away from the permanent structure. Thus, the added structure may provide a more complex overall structure or a structure which appears suspended above or around the permanent structure. In any case, it is possible to provide a lighting display which appears integral or otherwise unitary.

In one preferred form, the apparatus of the invention comprises a plurality of shaft members which are designed or adapted to extend along the permanent structure, and a plurality of structural members that intersect and join the shaft members. Both types of members are preferably compliant to fit the contours of the permanent structure, but sufficiently firm to retain any given or desired shape. It is also preferred that openings be formed or otherwise provided along the apparatus to enable the apparatus to be placed on or around the permanent structure. Additional tying members such as straps or other releasable members may be employed to hold the apparatus in place relative to the permanent structure, but to be readily removed when desired.

DESCRIPTION OF EXEMPLARY EMBODIMENTS

Figure 1:
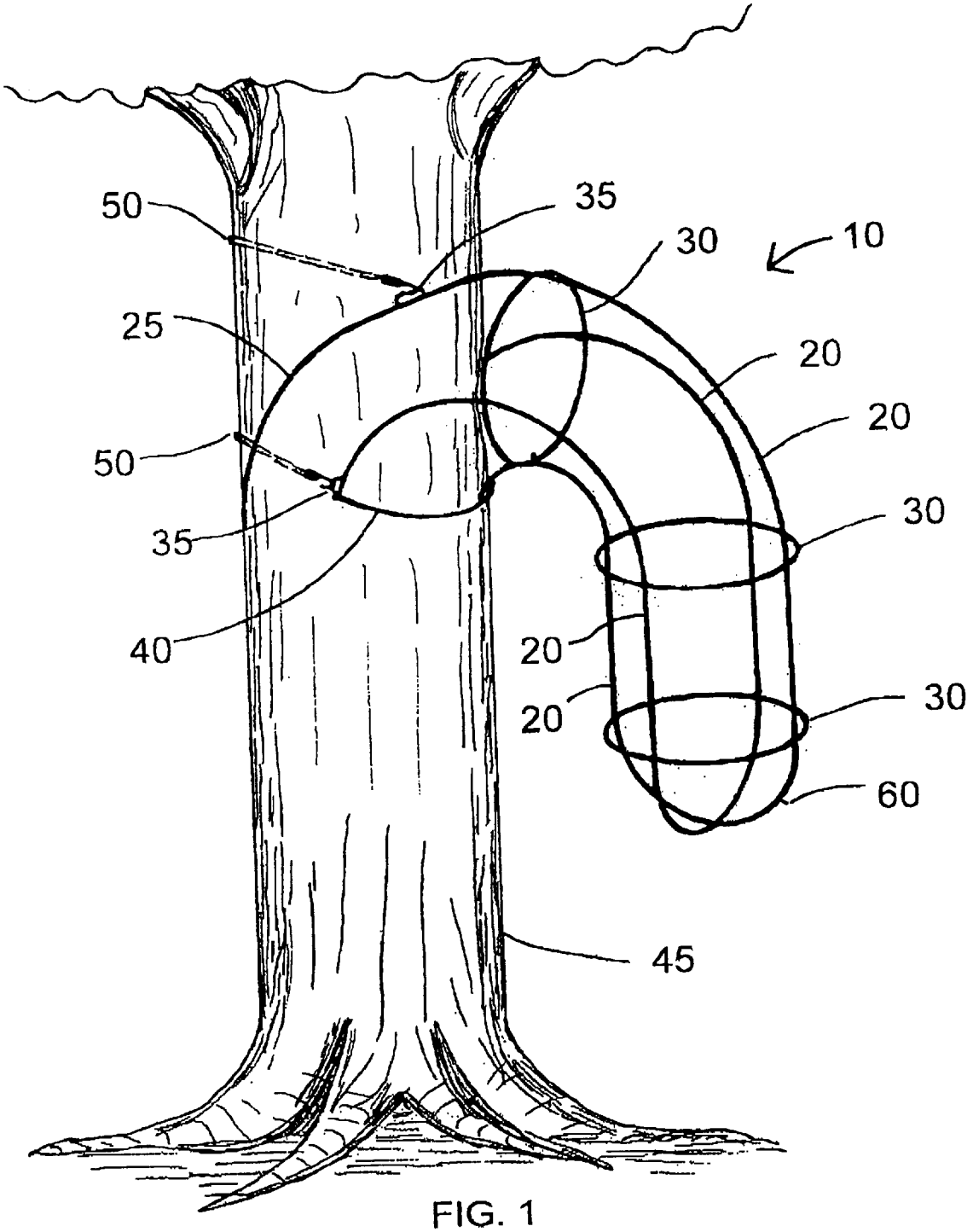
FIG. 1 is an isometric view of an ornamental lighting display according to the present invention.

FIG. 1 is an isometric view of an ornamental lighting frame 10 according to the present invention. The ornamental lighting frame 10 includes a plurality of shaft members 20 and a plurality of structural members 30. Shaft members 20 may be formed or may be shaped into any desired form. As shown in FIG. 1, the shaft members 20 are bent into a partial or ¾ semi-circle so that when attached along a permanent, and preferably stationary object, such as a tree, and lights are attached along shaft members 20 and/or structural members 30, the combination creates the appearance of a unitary display, appearing as a complete candy cane comprising both stationary object and ornamental lighting frame 10.

In an exemplary embodiment, there may be five shaft members 20 spaced substantially evenly about a central axis. Further, in an exemplary embodiment, there may be at least three structural members 30 which may be generally circular. These structural members 30 serve as attachment points for the plurality of shaft members 20 and provide for further shaping and structural integrity of the desired ornamental lighting frame 10. It is understood that although shown with five shaft members 20 and three structural members 30, the present invention contemplates use of a singular member that takes place of both the shaft members and the structural members. It is also to be understood that the present invention contemplates use of a singular shaft member and a singular structural member.

In exemplary embodiment, both the shaft members 20 and the structural members 30 may be comprised of a compliant or flexible material, such as wire, steel, aluminum, plastic, air-filled medium, such as a balloon or canvas, or injection molding material. Structural members 30 may be connected to the shaft members 20 by weld connections or by fastening by means of tie wires, straps, or bungee-type cords and eyelets connected to either the structural members 30 or the shaft members 20.

As shown in FIG. 1, at least one end of the ornamental lighting frame 10 may be open so that it may be attached to another object, preferably a stationary object, such as a tree trunk, a light post, a utility pole, fence post, column, pillar, rain gutter, or other such structure. As shown in FIG. 1, an exemplary embodiment includes an end structural member 40 that is not circular but rather generally semi-circular and therefore open for attachment. This end structural member 40 is a point of attachment of the ornamental lighting frame 10 to various objects, such as those described above. Depending on the shape of the object to which the ornamental lighting frame 10 is attached, many different shapes of end structural member 40 are possible, such as hexagons, squares, triangles, or the like. Also as shown in FIG. 1, several of the shaft members 20 are not connected to the end structural member 40. These shaft members 20 may therefore be adapted around the object to which the ornamental lighting frame 10 is to be connected to aid in permitting a unitary display between the object and the ornamental lighting frame 10. It is understood that end shaft member 40 is not necessary to the present invention, and all shaft members 20 may be unconnected at one end, and still be capable of being attached to the desired object. Alternately, it may be possible that shaft members 20 may be connected at one end and still capable of attachment to the desired object.

To support the ornamental lighting frame 10 on the object to which it is to be connected, various means of connection may be used. For example, one or more joining members 50, such as a bungee cord, may be adapted around the object to be joined and connected to both ends of the end structural member 40. Alternately, the object and the ornamental lighting frame 10 may be joined by means of an adjustable hinge or latch incorporated into the frame. Other means of connection may include, for example, adjustable straps, leather cords, rubber, rope, VELCRO material, or the like. As seen in FIG. 1, the end structural member 40 and certain shaft members 20 have a plurality of eyelets 35 to which the joining members 50 may be attached by means of hooks or the like.

In operation, the ornamental lighting frame 10 may be covered with a plurality of ornamental lights, such as strings of holiday lights and the like. These strings of lights may be wrapped around two or more of the shaft members 20 or any other way around the shaft members 20 and the structural members 30. Before or after wrapping the ornamental lighting frame 10 with the ornamental lights, the ornamental lighting frame 10 may be adjoined to the object to which it is to be attached. In an exemplary embodiment, that object may be a tree trunk. The ornamental lighting frame 10 may include a plurality of retaining members 60, such as pins, clips, hooks or the like, to affix lights to the frame. Although shown on only one shaft member 20 in FIG. 1, it is to be understood that the retaining members 60 may be connected to one or more of the shaft members 20, one or more of the structural members 30, and end structural member 40. As discussed above, the ornamental lighting flame 10 is connected to a tree trunk by securing a joining member 50 or the like around the trunk of the tree and into eyelets 35 of the end structural member 40 so that the ornamental lighting frame 10 is securably attached to the tree trunk. Alternate means of connection may include, for example, adjustable straps or a belt permanently affixed to the ornamental lighting frame 10.

Figure 2:
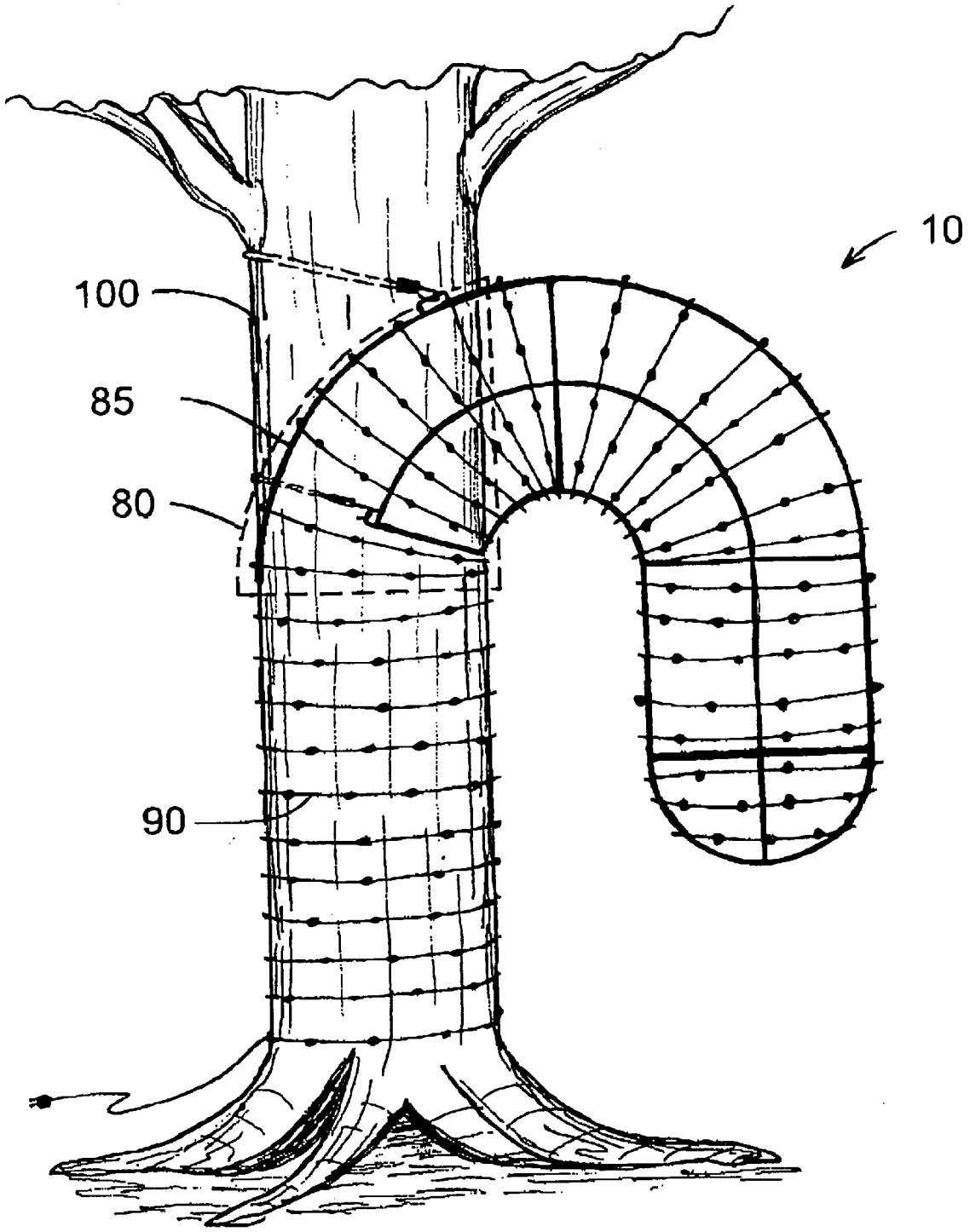
FIG. 2 is a side view of an ornamental lighting display according to the present invention in operation.

As shown in FIG. 2, ornamental lighting frame 10 is attached to a stationary object 100, which may be, for example, a tree. The area in which the frame 10 and object 100 meet is the transition area 80. It is to be understood that a display according to the present invention may include a plurality of transition areas. The transition area 80 will include trace contour lines 85 that permit standard lights (such as ornamental Christmas lights) to be attached along its contour, creating when lit, a continuation of the desired angular shape throughout the transition area 80, thus allowing the desired portion, pattern, shape, or angle of the object 100 to be engulfed in the unitary design of the ornamental lighting frame 10.

It is to be understood that portions of shaft members 20 (not shown in FIG. 2) are used as trace contour lines 85. When lit, lights attached to trace contour lines 85 engulf the object 100 into a unitary design with frame 10, thus transforming the two structures into one shared shape. In the embodiment shown in FIG. 2, this is a candy cane display. In exemplary embodiments, the trace contour lines 85 may include retaining members, which may be created by holes with clips, pegs, VELCRO strips, or the like. Of course, exemplary embodiments of the ornamental lighting frame may be many different sizes to accommodate different size objects, such as trees of varying sizes.

Also as shown in FIG. 2, the portion of the tree trunk below the ornamental lighting frame 10 may be wrapped with additional lights 90, thereby giving the impression of a unitary display between the tree trunk and ornamental lighting frame 10. This is a vast improvement over the prior art, as it was known to string lights around the tree alone, therefore no candy cane or other such design was created. By doing so, the present invention transforms an ordinary tree with lights into a work of art, which may take the shape of many forms other than a candy cane. In operation with the particular embodiment shown in FIG. 2, this may create the appearance of a candy cane that is unitary and continuous in nature so that it is very difficult to determine in the dark where the tree ends and the ornamental light frame 10 begins.

Figure 3:
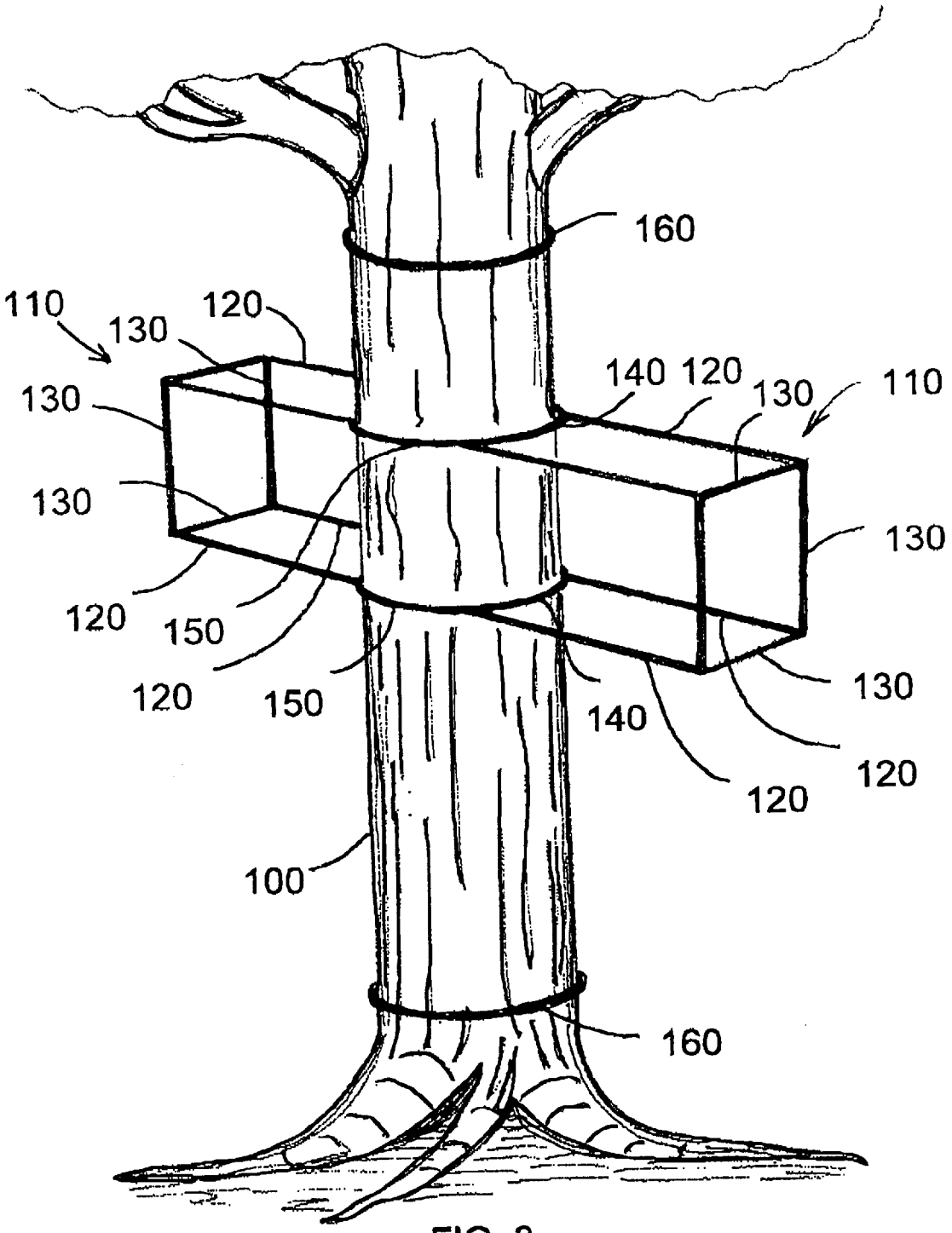
FIG. 3 is a side view of an alternate embodiment of the present invention.

FIG. 3 is an alternate embodiment of the present invention incorporating a religious cross design. As shown in FIG. 3, a plurality of ornamental lighting frames 110 may be connected to a stationary object 100, such as a tree trunk. The ornamental lighting frames 110 may be comprised of shaft members 120 and structural members 130. In an exemplary embodiment, certain shaft members 120 may be joined by one or more end structural members 140. However, such an end structural member is not required, and a joining member may be used to connect the shaft members 120. Alternately, the shaft members 120 need not be connected to each other. The ornamental lighting frames 110 may be connected to the stationary object 100 by means of a joining member 150, which may be connected between the ornamental lighting frames 110, thereby attaching the frames to the stationary object 100.

Ornamental lights may be laced throughout or around the ornamental lighting frames 110 and around the perimeter of the stationary object 100 to create a unitary display. As shown in FIG. 3, this display may be in the shape of a religious cross. In other embodiments, other displays may be created using two or more ornamental lighting frames having similar components but different shapes than that shown in FIG. 3.

Figure 4:
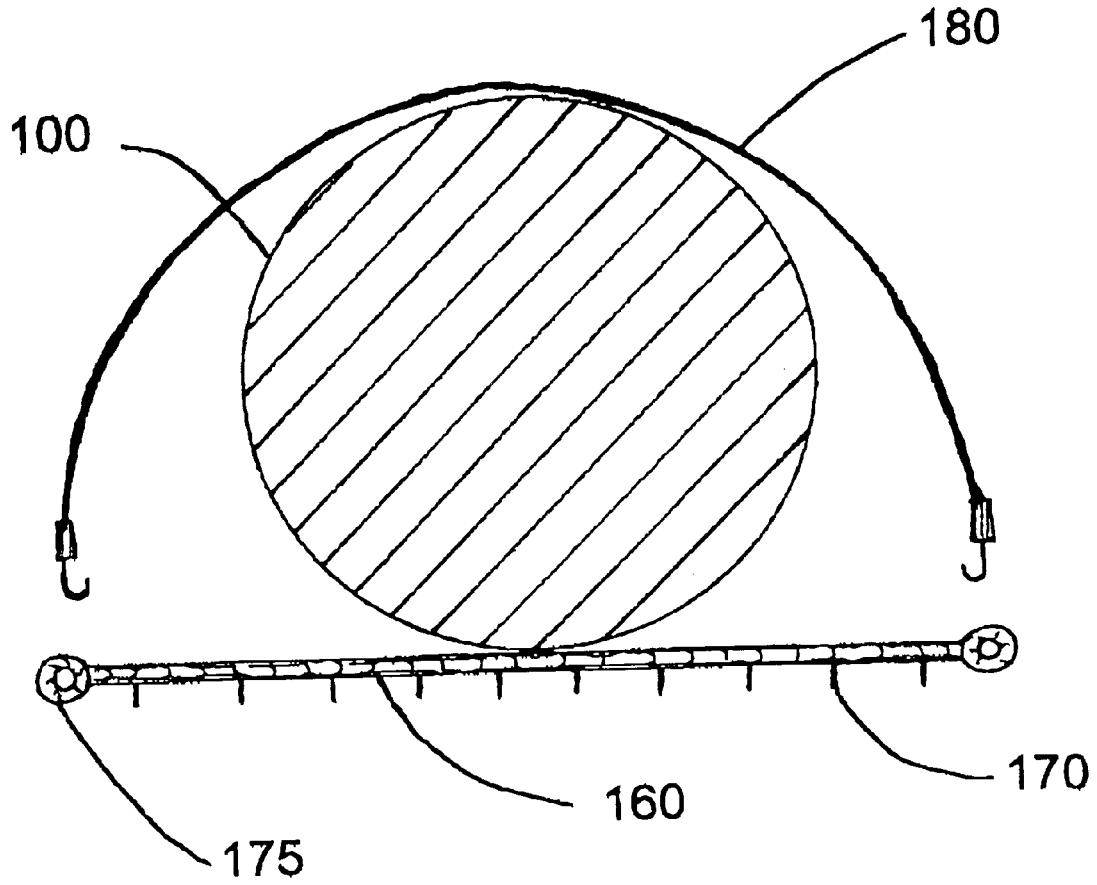
FIG. 4 is a top view of a joining member and trace contour line according to the present invention.

As shown in FIG. 3, trace contour lines 160 may provide attachment points for ornamental lights. FIG. 4 shows a trace contour line according to the present invention in more detail. As shown in FIG. 4, trace contour line 160 includes a plurality of retaining members 170 and a plurality of eyelets 175, so that the trace contour line 160 may be attached to joining member 180.

The displays of the present invention are an improvement over the prior art because the displays appear to engulf a portion of the object to which they are attached. In certain embodiments, the display can appear to float in space. This is an improvement because prior devices did not permit a unitary display such that a continuous flow of lights appeared between object and frame device. Other shapes that are possible with the present invention include, for example, angels, angel wings, a heart, religious crosses, Stars of David, bells, umbrellas, mushrooms, Christmas trees, champion classes, hour glasses, animals, such as a giraffe, and the like. In constructing a unitary display, multiple ornamental lighting frames may be attached to a tree or other object. For example, a giraffe can be made from a tree trunk and tree branches with multiple ornamental lighting frames attached. For example, the large neck portion of a giraffe or dinosaur design can be made from a tree trunk even if the tree leans off center by attaching multiple ornamental lighting frames (i.e. the head and body).

In alternate embodiments, the ornamental lighting frame of the present invention may be made of, for example, any type of pliable metal, injection molding material, a resilient plastic material, a resilient rubber material, or the like, and may comprise a solid frame. Further, the present invention may be used in connection with objects other than a tree trunk such as, for example, a light post, fence post or other indoor or outdoor fixture.

Another benefit of the present invention is that the ornamental lighting frame is detachable and reusable. Preferably, the lighting strings that are attached to the ornamental lighting frame remain fixed so that the device may be used and stored over many years and stored without requiring further preparation. Additionally, because the ornamental lighting frame is married to an already existing structure, only a fraction of the raw material required to create a display of the same resulting size of structure and frame is necessary. This size benefit permits creation and display of much larger ornaments to enhance any special occasion, such as a party, birthday, or holiday.

Further modification and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having benefit of this description of the invention.

What is claimed is:

1. An apparatus for attachment to a permanent object to enable a unitary lighting display between said apparatus and said permanent object, comprising:

at least one shaft member adapted to extend along at least a portion of said permanent object;

at least one structural member attached to said at least one shaft member, said at least one structural member configured to extend at least partially around the permanent object to define a transition area between said apparatus and said permanent object, said structural member enabling the apparatus to be fitted around the permanent object;

a plurality of trace contour lines adapted along said apparatus, said contour lines configured to secure lights throughout said apparatus and throughout said transition area; and said apparatus adapted to mount a lighting display integral in appearance with a lighting display on the permanent object and with lights within said transition area to thereby enable said unitary lighting display.

2. The apparatus of claim 1, further comprising a plurality of shaft members held together by said at least one structural member.

3. The apparatus of claim 1, further comprising at least one connecting member to urge said apparatus and said permanent object together.

4. The apparatus of claim 1, further comprising a plurality of ornamental lights on said apparatus.

5. The apparatus of claim 4, further comprising a plurality of retaining members to hold said plurality of ornamental lights to said apparatus.

6. The apparatus of claim 3, wherein said at least one connecting member comprises a bungee cord.

7. The apparatus of claim 1, further comprising a plurality of structural members.

8. The apparatus of claim 1, wherein said unitary lighting display comprises a candy cane display.

9. The apparatus lighting frame of claim 1, wherein said unitary lighting display comprises an angel wing display.

10. The apparatus of claim 1, wherein said trace contour lines comprise a plurality of retaining members.

11. An ornamental lighting frame for attachment to a permanent object to permit a unitary display between said ornamental lighting frame and said object, comprising:

at least one structural member;

a plurality of shaft members, each of said plurality of shaft members being attached to said at least one structural member;

a plurality of trace contour lines adapted along said lighting frame, said contour lines configured to secure lights throughout said lighting frame and throughout a transition area defined between said lighting frame and said object;

an end structural member, at least one of said plurality of shaft members being connected to said end structural member; and a joining member for joining said ornamental lighting frame to said object, thereby permitting said unitary display.

12. The ornamental lighting frame of claim 11, wherein said at least one structural member comprises a generally circular design.

13. The ornamental lighting frame of claim 11, wherein said joining member is connected around said end structural member.

14. The ornamental lighting frame of claim 11, wherein said end structural member comprises a generally semi-circular design.

15. The ornamental lighting frame of claim 11, further comprising a plurality of ornamental lights adapted about at least one of said plurality of shaft members.

16. The ornamental lighting frame of claim 11, wherein said plurality of trace contour lines comprises a plurality of retaining members.

17. An apparatus for attachment to a permanent object to enable a unitary candy cane lighting display between said apparatus and said permanent object, comprising:

at least one shaft member adapted to extend along at least a portion of said object;

at least one structural member attached to said at least one shaft member, said at least one structural member configured to extend at least partially around the permanent object so as to enable the apparatus to be fitted around the permanent object; and said apparatus adapted to mount a lighting display integral in appearance with a lighting display on the permanent object to thereby enable said unitary candy cane lighting display.

18. An apparatus for attachment to a permanent object to enable a unitary angel wing lighting display between said apparatus and said permanent object, comprising:

at least one shaft member adapted to extend along at least a portion of said object;

at least one structural member attached to said at least one shaft member, said at least one structural member configured to extend at least partially around the permanent object so as to enable the apparatus to be fitted around the permanent object; and said apparatus adapted to mount a lighting display integral in appearance with a lighting display on the permanent object to thereby enable said unitary angel wing lighting display.

* * * * *